US007258045B2

(12) United States Patent
Smith

(10) Patent No.: US 7,258,045 B2
(45) Date of Patent: Aug. 21, 2007

(54) TREE STEP TOOL

(76) Inventor: Cary Lester Smith, 5610 N. 600 W., Marion, IN (US) 46952

( * ) Notice: Subject to any disclaimer, the term of this patent is extended or adjusted under 35 U.S.C. 154(b) by 0 days.

(21) Appl. No.: 11/235,167

(22) Filed: Sep. 27, 2005

(65) Prior Publication Data

US 2007/0068347 A1 Mar. 29, 2007

(51) Int. Cl.
*B25B 13/48* (2006.01)
*B25B 13/56* (2006.01)

(52) U.S. Cl. ..... 81/176.2; 182/92; 81/176.15

(58) Field of Classification Search ..... 81/176.15, 81/176.2, 52, 901; 182/90, 92, 129; 29/270
See application file for complete search history.

(56) References Cited

U.S. PATENT DOCUMENTS 2,437,762 A * 3/1948 Simonin ..... 81/119
5,624,007 A 4/1997 Mahaffy
5,743,353 A * 4/1998 Browning et al. ..... 182/92
5,806,625 A 9/1998 Katz
5,899,124 A * 5/1999 Cross, Jr. ..... 81/176.15
5,944,139 A 8/1999 Kozial
6,439,343 B1 8/2002 Jorges et al.
6,729,437 B1 5/2004 Apple
7,017,449 B1 * 3/2006 Ritchings ..... 81/52

* cited by examiner

*Primary Examiner*—D. S. Meislin
(74) *Attorney, Agent, or Firm*—Rothwell, Figg, Ernst & Manbeck

(57) ABSTRACT

In accordance with the present invention, a tool for inserting and removing rod-type steps includes a handle and a head. The head includes a first surface having a first hole and a second surface, parallel to the first surface, having a second hole. The first hole and the second hole define a centerline. The head also includes a tang having first and second scallops disposed on opposing edges. The tang is perpendicular to the first and second surfaces and offset from the centerline.

12 Claims, 3 Drawing Sheets

100

TREE STEP TOOL

FIELD OF THE INVENTION

The present invention relates generally to tree steps and, more particularly, to a tool for the inserting and removing rod-type tree steps.

BACKGROUND OF THE INVENTION

Various designs for removable steps used to climb trees, telephone poles, etc., are known in the art, as well as complimentary tools for inserting and removing them.

For example, U.S. Pat. No. 5,624,007 to Mahaffy discloses a device for insertion and removal of rod-type tree steps with vertically spaced apart horizontal sections. The device has a hollow portion that surrounds the vertical section of the step and a guide slot for threading a horizontal section of the tree step. The guide slot requires a bolt or another means of securing the device to the horizontal section. The device is secured onto the tree step by a bolt or screw, and the user cranks the tree step into (or out of) the tree using the leverage from the vertically disposed central section of the device.

U.S. Pat. No. 5,806,625 to Katz discloses a tree step tool using a telescopic applicator, the inner sleeve of which is attached to the tree step. The outer sleeve consists of a long handle that may extend telescopically and a pin to lock the handle in position. The user then grips and turns the handle to remove or install the tree step.

Known tree step insertion and removal tools suffer from many disadvantages. Some tools are unnecessarily complicated in that they require additional mechanism(s) to secure the tree step to the tool itself before inserting or removing the step. Other tools include relatively-moving parts that may bind, slip out of alignment, etc. A tool is therefore needed that permits ease of step installation and removal without the drawbacks associated with known constructions.

SUMMARY OF THE INVENTION

In accordance with embodiments of the present invention, a tool for inserting and removing rod-type steps includes a handle and a head. The head includes a first surface having a first hole and a second surface, parallel to the first surface, having a second hole. The first hole and the second hole define a centerline. The head also includes a tang having first and second scallops disposed on opposing edges. The tang is perpendicular to the first and second surfaces and offset from the centerline.

BRIEF DESCRIPTION OF THE DRAWINGS

The above and other advantages of this invention will become more apparent by the following description of invention and the accompanying drawings.

DETAILED DESCRIPTION

Figures 1A, 1B, 1C, 1D:
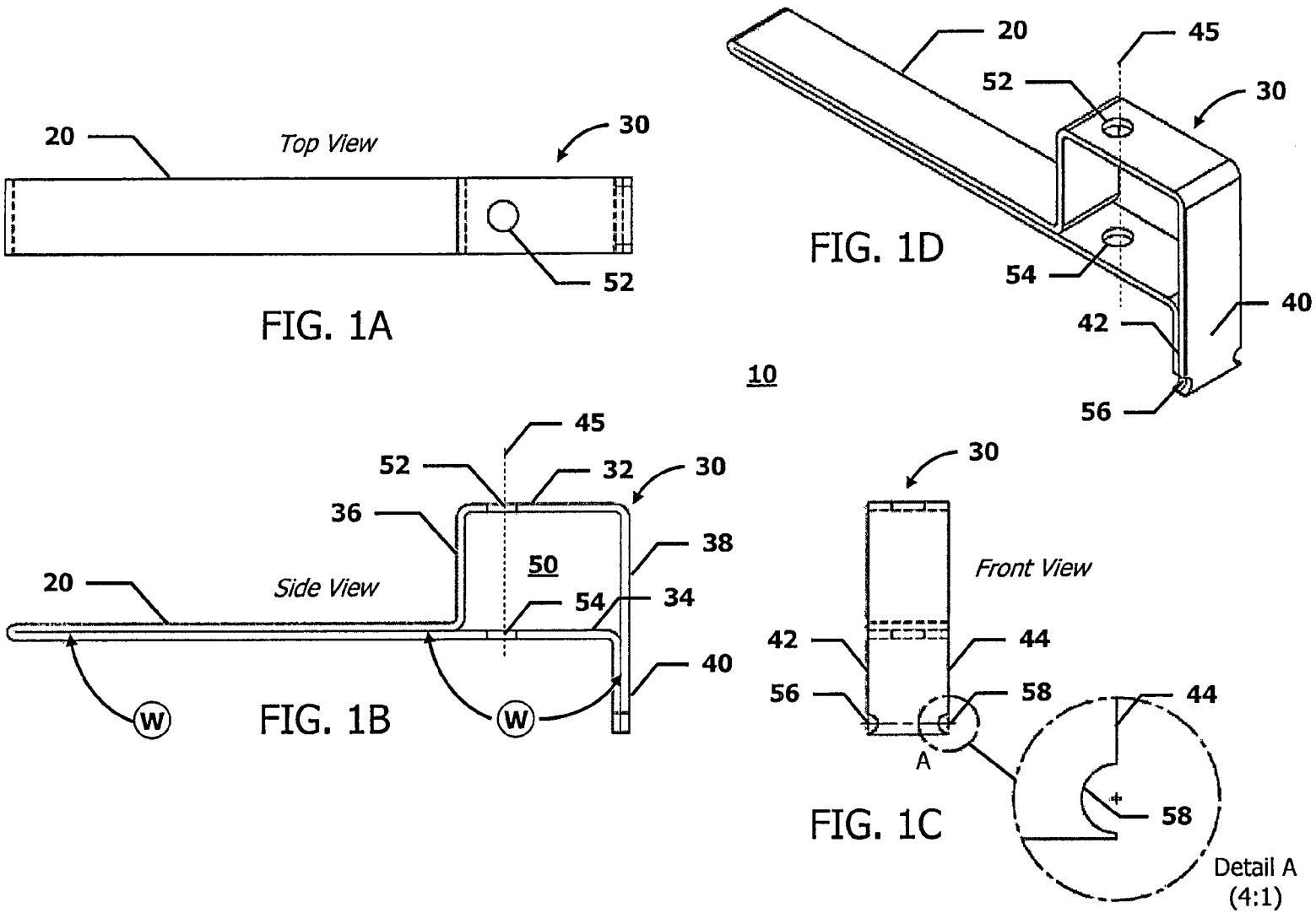
FIGS. 1A, 1B, 1C and 1D are top, side, front and isometric views of an embodiment of the present invention.
Figure 2D:
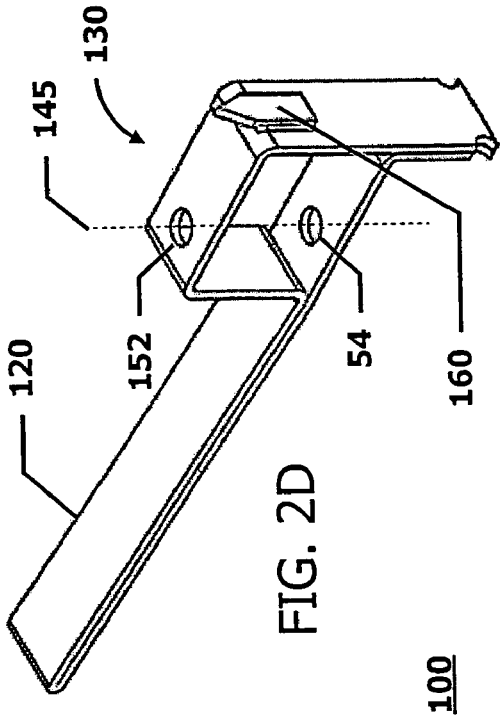
FIGS. 2A, 2B, 2C and 2D are top, side, front and isometric views of further embodiments of the present invention.
Figure 2C:
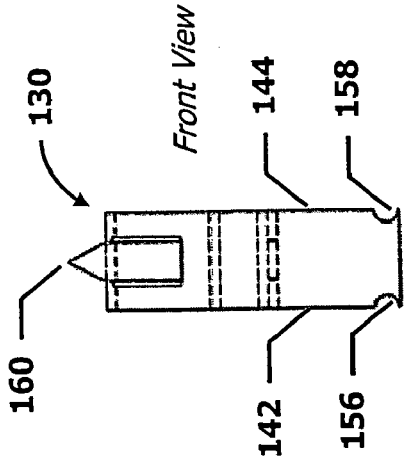
Figure 2A:
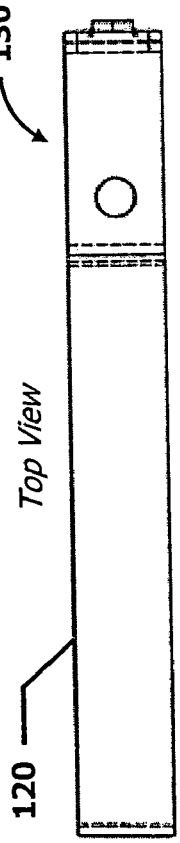
Figure 2B:
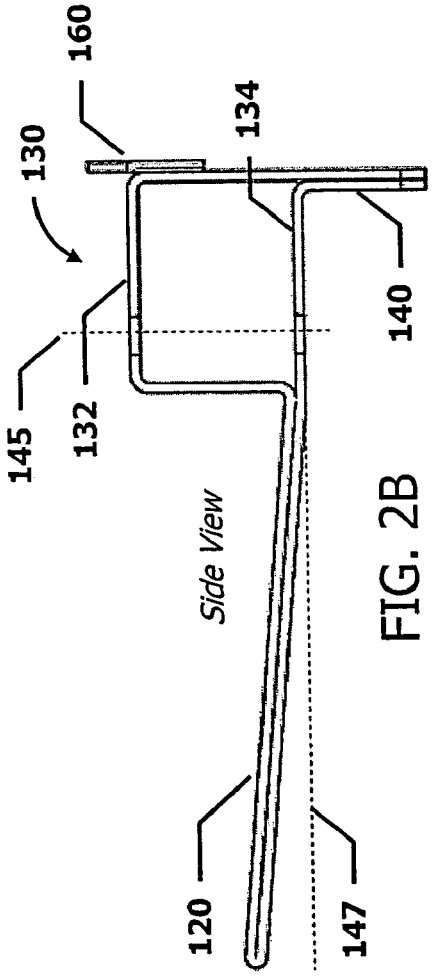

FIGS. 1A, 1B, IC and 1D present top, side, front and isometric views of one embodiment of the present invention.

An attachment tool 10 includes a handle 20 and a head 30. Generally, attachment tool 10 engages a threaded, rod-type step to insert and remove the step from a suitable object, such as a tree, a telephone pole, etc. When attachment tool 10 is engaged with the step in an insertion orientation, a torque may be applied to the step, through handle 20, to drive the step into the object. Similarly, when the attachment tool 10 is engaged with the step in a removal orientation, an opposite torque may be applied to the step, through handle 20, to back the step out from the object. The direction of the step threads determine the insertion and removal orientations of attachment tool 10, and a right-hand thread will be assumed for description purposes.

Figure 3:
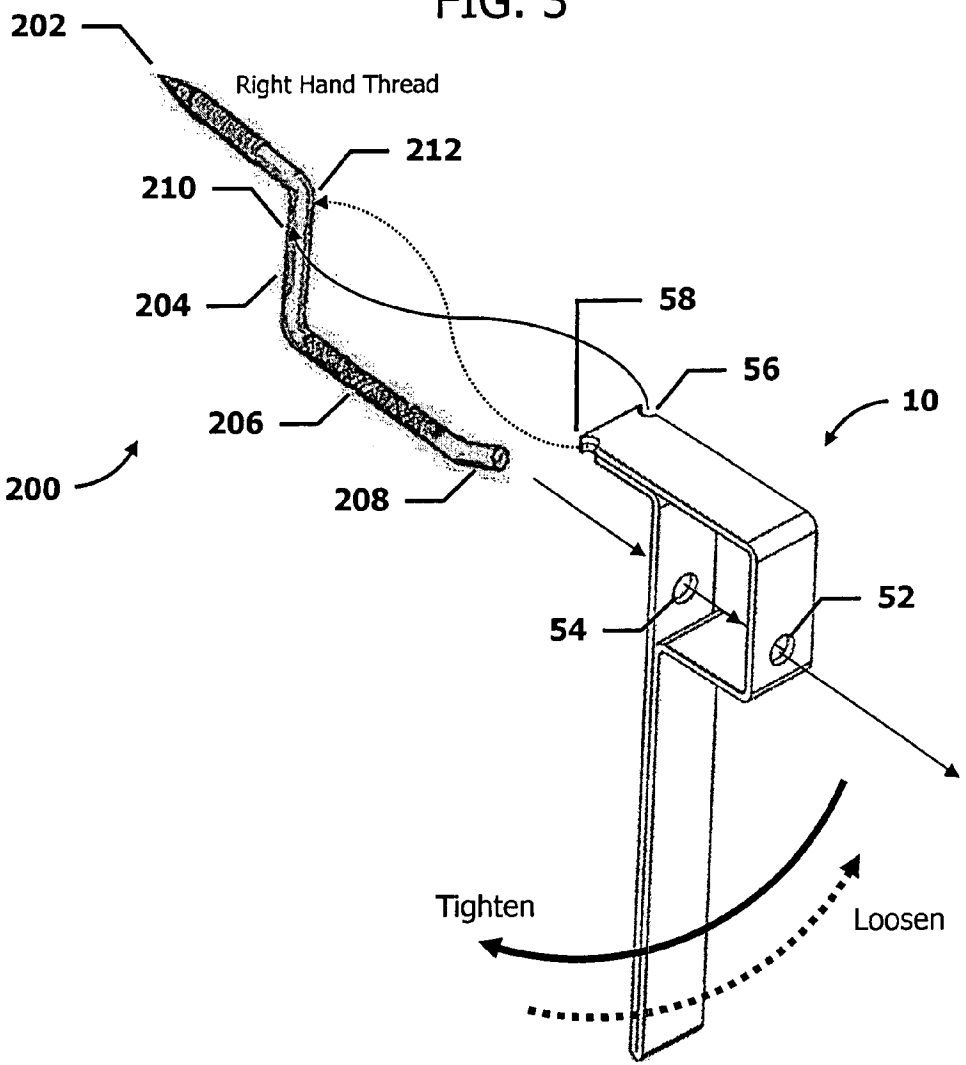
FIG. 3 is an isometric view of an embodiment of the present invention depicting both the step and the attachment tool.

As shown in FIG. 3, for example, an exemplary rod-type step 200 has a circular cross-section and includes a threaded section 202, a central section 204 and a step section 206 substantially parallel to threaded section 202. Threaded section 202 and step section 206 extend away from central section 204 in opposite directions. Step 200 may include a knurled portion along step section 206 as well as an angled end portion 208. Of course, other well-known variations of rod-type step 200 may be accommodated by attachment tool 10.

Head 30 is connected to handle 20 and includes a top surface 32 and a bottom surface 34 parallel to top surface 32. In this embodiment, top and bottom surfaces 32, 34 are substantially parallel to handle 20. Top surface 32 includes a top hole 52, while bottom surface 34 includes a bottom hole 54 aligned with top hole 52. Top and bottom holes 52, 54 accommodate rod-type steps having a diameter of, for example, approximately 0.375" and are slightly over-sized to accommodate angled end portion 208. Other step diameters may be accommodated simply by forming appropriately-sized holes. Centerline 45, passing through the center of top hole 52 and the center of bottom hole 54, is parallel to, and offset from, a tang 40. Alternatively, top hole 52 and bottom hole 54 may be slightly offset from one another, so that centerline 45 is slightly skewed with respect to tang 40.

Tang 40 is substantially perpendicular to top and bottom surfaces 32, 34 and depends below handle 20. Alternatively, tang 40 may be inclined with respect to top and bottom surfaces 32, 34. Tang 40 includes edges 42, 44, each of which includes an indented section, or scallop, formed to engage the central portion 204 of step 200 during insertion or removal. Scallop 56, disposed towards the bottom of edge 42, engages an area 210 of central section 204 when attachment tool 10 is arranged for step insertion (assuming right handed threads). Similarly, scallop 58, disposed towards the bottom of edge 44, engages an area 212 of central section 204 when attachment tool 10 is arranged for step removal. Scallops 56, 58 may be circular in cross-section to comport with the shape of rod-type step 200, as shown, for example, in Detail A of FIG. 1C. In alternative embodiments, scallops 56, 58 may each be disposed, within their respective edges, near the center of tang 40 or near the top of tang 40, and scallops 56, 58 may be formed in the shape of a "V".

In an embodiment, head 30 includes a main section 50 having a substantially rectangular cross-section consisting of top and bottom surfaces 32, 34, a back surface 36 which is perpendicular to top and bottom surfaces 32, 34, and a front surface 38 which is parallel to back surface 30. Alternatively, main section 50 may have a trapezoidal cross-section, in which top and bottom surfaces 32, 34 are substantially parallel but form an angle other than 90 degrees with respect to front and back surfaces 38, 30.

In an embodiment, attachment tool 30 is formed from a single piece of steel strap, such as, for example, 10 gauge cold-rolled steel. The strap is bent into the proper shape and then welded at various locations. FIG. 1B indicates several exemplary weld locations using the letter "W" within a circle. Different strap thicknesses, widths and lengths may be employed, such as, for example, a strap thickness of 0.125", a strap width of 1.250" and a strap length of approximately 36" to 40". In this example, handle 20 is approximately 7" in length, tang 40 is approximately 1.5" in length, and main section 50 is approximately 2" by 3". In another embodiment, handle 20 and head 30 may be formed separately and then joined together using any number of well known techniques.

FIGS. 2A, 2B, 2C and 2D present other embodiments of the present invention.

An attachment tool 100 includes a handle 120 and a head 130. Top surface 132 includes a top hole 152, while bottom surface 134 includes a bottom hole 154 aligned with top hole 152. Centerline 145, passing through the center of top hole 152 and the center of bottom hole 154, is parallel to, and offset from, a tang 140. Alternatively, top hole 152 and bottom hole 154 may be slightly offset from one another, so that centerline 145 is slightly skewed with respect to tang 140.

Tang 140 is substantially perpendicular to top and bottom surfaces 132, 134 and depends below handle 120. Alternatively, tang 140 may be inclined with respect to top and bottom surfaces 132, 134. Tang 140 includes edges 142, 144, each of which includes an indented section, or scallop, formed to engage the central portion 204 of step 200 during insertion or removal. Scallop 156, disposed towards the end portion of edge 142, engages an area 210 of central section 204 when attachment tool 100 is arranged for step insertion (assuming right handed threads). Similarly, scallop 158, disposed towards the end portion of edge 144, engages an area 212 of central section 204 when attachment tool 100 is arranged for step removal. Scallops 156, 158 may be formed in the shape of a semi-circle, or, alternatively, scallops 156, 158 may be formed in the shape of a "V".

In one embodiment, handle 120 is angled in an upward direction relative to baseline 147, which is parallel to top and bottom surfaces 132, 134. A slight upward angle, such as, for example, 5° to 10°, advantageously allows for additional clearance between handle 120 and the object when the user rotates attachment tool 100 and step 200, thereby reducing the likelihood that the object will scrape the user's hand during the process.

In another embodiment, head 130 includes a weldment or spike 160 for creating a small starter hole in which step 200 may be placed. In this embodiment, the user strikes the tree with tip of spike 160 to create the starter hole. Spike 160 may be formed, for example, from cold-rolled steel strap and welded to head 130.

FIG. 3 is an isometric view of an embodiment of the present invention depicting both the step and the attachment tool.

In order to engage attachment tool 10 with step 200, the user first slides step section 206 through bottom hole 54 and then through top hole 52, manipulating the attachment tool 10 as appropriate to accommodate the step's angled end portion 208 (if necessary). The user then adjusts attachment tool 10 relative to step 200 so that central section 204 falls within either scallop 56 or scallop 58, depending upon whether step 200 is to be inserted or removed.

Assuming a right-hand threaded step, engaging scallop 56 with step area 210 and then turning handle 20 in a clockwise direction (e.g., "Tighten") will drive step 200 into the object. Similarly, engaging scallop 58 with step area 212 and then turning handle 20 counter-clockwise (e.g., "Loosen") will remove step 200 from the object.

While this invention has been described in conjunction with specific embodiments thereof, many alternatives, modifications and variations will be apparent to those skilled in the art. Accordingly, the preferred embodiments of the invention as set forth herein, are intended to be illustrative, not limiting. Various changes may be made without departing from the true spirit and full scope of the invention as set forth herein.

What is claimed is:

1. A tool for inserting and removing rod-type steps, comprising:
- a handle; and
- a head, connected to the handle, including:
  - a first surface having a first hole,
  - a second surface, parallel to the first surface, having a second hole, the first hole and the second hole defining a centerline therethrough,
  - a tang, perpendicular to the first and second surfaces and offset from the centerline, the tang having a first scallop and a second scallop disposed on opposing edges, and
  - a main section having a substantially rectangular cross section, the main section consisting of the first surface, the second surface, a third surface and a fourth surface parallel to the third surface and the tang.

2. The tool according to claim 1, wherein the handle and the head are formed from a single member.

3. The tool according to claim 1, wherein the handle is parallel to the first and second surfaces.

4. The tool according to claim 1, wherein the handle is angled relative to the first and second surfaces.

5. The tool according to claim 1, further comprising a spike portion attached to the head.

6. The tool according to claim 1, wherein the first and second scallops are located at a central portion of the tang.

7. A system for inserting and removing rod-type steps, comprising:
- a plurality of rod-type steps, each including:
  - a central section having a front end and a back end,
  - a threaded section, having a threaded portion, extending in a first direction from the front end of the central section, and
  - a step section extending, in a second direction opposite to the first direction, from the back end of the central section; and an attachment tool, including:
  - a handle; and
  - a head, connected to the handle, including:
    - a first surface having a first hole for receiving said step section,
    - a second surface having a second hole for receiving said step section,
    - a tang having a first scallop for engaging the central section of the step when the attachment tool is arranged for insertion and a second scallop for engaging the central section of the step when the attachment tool is arranged for removal, the first and second scallops disposed on opposing, and
    - a main section having a substantially rectangular cross section, the main section consisting of the first surface, the second surface, a third surface and a fourth surface parallel to the third surface and the tang.

8. The system according to claim 7, wherein the handle and the head are formed from a single member.

9. The system according to claim 7, wherein the handle is parallel to the first and second surfaces.

10. The system according to claim 7, wherein the handle is angled relative to the first and second surfaces.

11. The system according to claim 7, further comprising a spike portion attached to the head.

12. The system according to claim 7, wherein the first and second scallops are located at a central portion of the tang.

* * * * *